United States Patent [19]

Whipple et al.

[11] 4,240,341

[45] Dec. 23, 1980

[54] CAN CRUSHER

[75] Inventors: Robert L. Whipple, P.O. Box 108, Camino, Calif. 95709; William F. Warren, Orangevale, Calif.

[73] Assignee: Robert Whipple, Camino, Calif.

[21] Appl. No.: 966,970

[22] Filed: Dec. 6, 1978

Related U.S. Application Data

[63] Continuation-in-part of Ser. No. 689,257, May 24, 1976, abandoned.

[51] Int. Cl.[3] ..... B30B 1/18; B30B 9/32

[52] U.S. Cl. ..... 100/49; 100/53; 100/209; 100/215; 100/218; 100/256; 100/290; 100/DIG. 2

[58] Field of Search ..... 241/99, 263; 100/DIG. 2, 209, 295, 215, 256, 186, 53, 49, 218, 289, 186

[56] References Cited

U.S. PATENT DOCUMENTS

| | | | |
|---|---|---|---|
| 47,591 | 5/1865 | Wilber | 100/209 |
| 561,133 | 6/1896 | Roop | 100/209 X |
| 2,737,995 | 3/1956 | Jennings | 100/DIG. 2 |
| 2,962,959 | 12/1960 | Sholin | 100/289 X |
| 3,162,114 | 12/1964 | Quiroz | 100/49 X |
| 3,412,675 | 11/1968 | Killough | 100/215 |
| 3,887,470 | 6/1975 | Weber | 100/186 |
| 3,916,780 | 11/1975 | Heiser | 100/49 |
| 3,960,070 | 6/1976 | McClure | 100/49 |
| 3,983,800 | 10/1976 | Booth | 100/215 |

FOREIGN PATENT DOCUMENTS

| | | | |
|---|---|---|---|
| 1392203 | 2/1965 | France | 100/DIG. 2 |
| 102349 | 11/1916 | United Kingdom | 100/209 |

*Primary Examiner*—Billy J. Wilhite
*Attorney, Agent, or Firm*—Mark C. Jacobs

[57] ABSTRACT

A can crushing apparatus is disclosed comprising a reciprocating head which reciprocates between two fixed walls whereby on each stroke of the head, two crushing operations are performed. Automatic can feeding means, having safety switch prime mover activation capability mounted thereon, is provided. A trash container closure base for said apparatus is also disclosed.

10 Claims, 12 Drawing Figures

CAN CRUSHER

This application is a continuation-in-part of our previous application Ser. No. 689,257, filed May 24, 1976, now abandoned.

BACKGROUND OF THE INVENTION

1. Field of the Invention

This invention relates to a device for crushing cans, such as beer cans, pop cans and the like more particularly, to a can crusher which is double-acting in the sense that a can can be crushed at both ends of the path of movement of a two-sided ram.

2. Description of the Prior Art

Many devices have been built and/or proposed for crushing cans. For the most part, however, these can crushers are inefficient and slow in operation. The following references are known to the inventors:

| | |
|---|---|
| Killough et al | 3,412,675 |
| Mc Clure | 3,960,070 |
| Heiser | 3,916,780 |
| Booth | 3,983,800 |

None of the devices disclosed and claimed in these four references alone or in combination possess the features and advantages of the devices of this invention.

The emphasis on the conservation of natural resources has provided an impetus to the development of methods and apparatuses for compacting used products for ease of disposal or for their constituent raw materials. Containers in which various products and particularly those in which beverages are packed and sold can accumulate in profusion so as to create a particularly acute problem for disposal. Yet such containers, and particularly those of aluminum, are easily recycled to reclaim their constituent raw material. Various devices have been developed to compact such containers. They are usually of comparatively large size and accordingly require the use of relatively cumbersome and expensive operative elements. Such devices have not successfully combined the capability of reliably compacting items with the ability to operate in complete safety while being of a compact size and of a cost compatible for bar or restaurant use. It has been recognized that it would be desirable to have an aluminum can compacting device capable of dependable operation without danger of injury to the operator and being of a size and cost acceptable for restaurant and bar usage.

SUMMARY OF THE INVENTION

It is therefore an object of the present invention to provide an improved aluminum can compacting device.

Another object is to provide such a device which incorporates safety features to permit virtually foolproof operation.

Another object is to provide a can crusher which achieves an efficiency of operation and a simplicity of structure not heretofore available.

Another object is to provide a device which compacts and discharges cans individually rather than accumulating the compacted material.

A further object is to provide such a device which combines the attributes of dependability of performance and safety of operation in a device at a cost suitable for bar and restaurant use.

In accordance with the objects of this invention, the present invention relates to a can crusher comprising a pair of opposed fixed heads, a laterally reciprocal mashing head reciprocable relative to the opposed fixed heads means are provided for reciprocating the reciprocal head between the opposed fixed heads. A support extends between the fixed heads and the reciprocal head. The fixed heads and the reciprocal heads have substantially flat and parallel confronting faces for engaging the confronting rims of a can and therethrough applying axial pressure to crush the side walls of a can between one fixed head and one side of the reciprocal head on one stroke, and between the second fixed head and the second side of the reciprocal head on the next stroke.

The reciprocal head comprises a single head having opposed faces, each of the opposed faces being substantially flat and parallel to one another and parallel to the faces of the fixed heads. The reciprocating means comprises threaded shaft means operably connected to the reciprocal head for moving the reciprocal head in a reciprocating direction. One shaft turns rightwardly, and the other turns leftwardly.

The prime mover employed comprises a reversible motor such as a reversible electrical motor along with a reversing switch operably connected to the motor and mounted adjacent to one of the fixed heads for reversing the direction of the motor when the reciprocal head is moved next adjacent to one of the fixed heads.

A gravity fed can feeding means comprising a chute positioned above the reciprocal head for feeding a can into the can crusher so that when the reciprocal head's first side is moved substantially towards one of the fixed heads, the next can drops into the support to be crushed by the reciprocal head's second side on the return stroke.

A support for the fed cans extends part of the distance between the fixed heads downward openings adjacent the fixed heads, the openings being of a width greater than the thickness of a can crushed between the reciprocal head and the fixed head are provided so that crushed cans can drop by gravity downward and out of the device for collection.

Further objects of the invention will be readily understandable from a review of the drawings and the description of the embodiments.

DESCRIPTION OF THE PREFERRED EMBODIMENT

Figure 1:
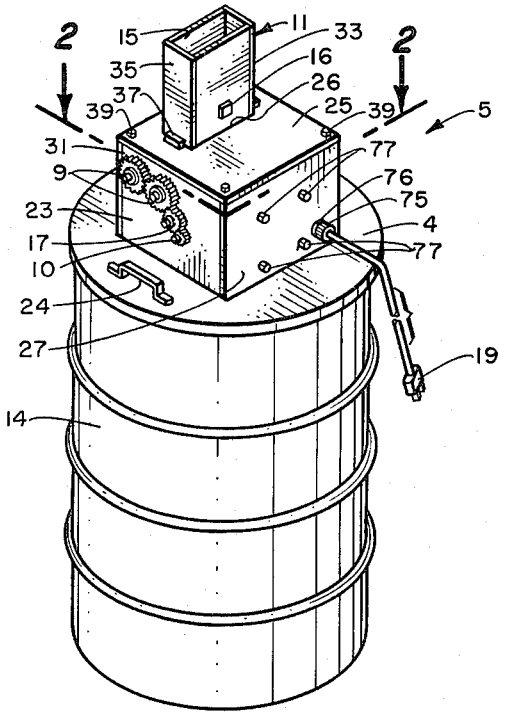
FIG. 1 is a side perspective view of the device of this invention mounted on an optional base, said base itself being disposed upon a trash can.

As seen in FIG. 1, can crushing device 5 comprises a generally rectangular housing having a front wall 31, a left side wall 29, an intermediate right wall 23 and a rear wall 27. A top 25 sized to enclose the housing is provided with an opening 26 therein adapted to receive can feeding chute 11. Top 25 is secured by bolts 39.

Referring to the can crushing apparatus 5, it is comprised of a mashing head 6 mounted for lateral reciprocal movement between fixed walls 29 and 23, head 6 is mounted on threaded shafts 3 and 3A. Shafts 3 and 3A in turn are secured to the fixed walls 29 and 23 through bearings 7 and 7A. Shafts 3 and 3A turn in opposite directions, 3 moving leftwardly and 3A rightwardly in motion. They are driven by a prime mover 8 such as an electrical motor which is operatively connected to shafts 3 and 3A through motor gear 10 and carrying gear 17. Each of 3 and 3A terminate in a gear 9, all of which gears are operatively connected.

The shafts 3 and 3A have threads cut thereon and threadably engage openings 68 in mashing head 6 in order to drive head 6 towards fixed walls 29 and 23. The direction of movement of the mashing head 6 may be reversed by a reversing mechanism operatively connected to the prime mover comprising an electrical motor 8.

Figure 2:
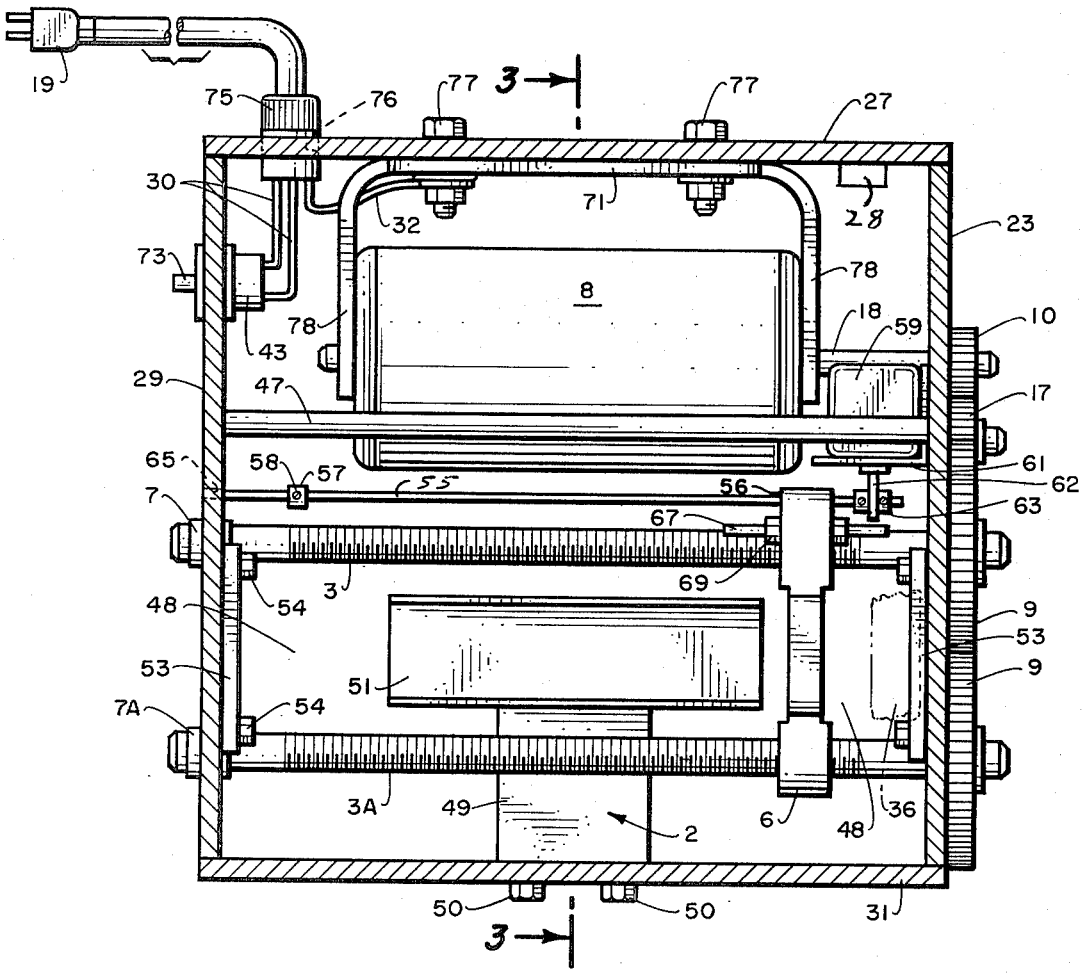
FIG. 2 is a top plan view taken alon LINE 2—2 of FIG. 1 of one embodiment of the device of this invention.
Figure 3:
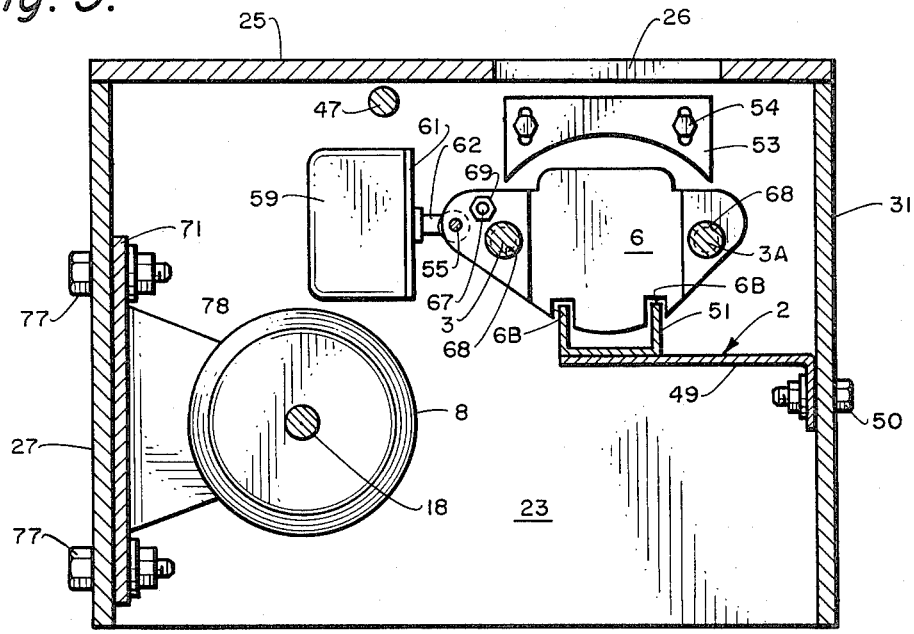
FIG. 3 is a sectional elevational view of the device of this invention taken along LINE 3—3 of FIG. 2.

As is readily seen from a reference to FIG. 2 and FIG. 3, rod 55 is disposed between wall 29 and reversing switch 59's handle 62. The handle 62 has an aperture not seen through which 55 is inserted on one end and secured thereto by stops 63 on either side of handle 62, said stops being retained on rod 55 by Allen screws 58. On the opposite end of said rod 55 attached therewith in wall 29 is aperture 65 through which rod 55 is inserted. Rod 55 is seen therefore to be capable of reciprocal motion to reverse switch 59 by the reciprocating action of mashing head 6. Thus, when mashing head 6 approaches leftwardly to single stop 57, rod 55 is urged further through said aperture 65 and in view of the connection to handle 62, said handle is moved leftwardly, thereby changing the direction of the operation of motor 8. When head 6 contacts stop 57, rod 55 moves a distance equal to handle 62's throw.

When mashing head 6 moves rightwardly, it will impinge upon one of the two stops 63 located adjacent switch 59 and upon which impinges handle 62 which is moved rightwardly, thus reversing the direction of operation of motor 8. Aperture 56 is provided within mashing head 6 and through which is disposed rod 55. It is seen therefore that during the course of travel between the stops 57 and 63 by head 6, that rod 55 remains stationary.

Bolt 67 is disposed through a suitable hole in head 6, adjacent aperture 56, and is retained by bolts 69. This combination serves as a safety device to prevent the mash head 6 from moving too far along thread shaft 3 in either direction, thereby preventing the destruction of switch 59. The tip of bolt 67 will hit a side wall, thus stopping head 6.

As has been indicated, threaded shafts 3 and 3A relate in opposite directions, and the gear 9 attached to each of said shafts also will move in opposite directions. Gears 9 are operatively connected to carrying gear 17 and to motor gear 10 attached to motor shaft 18 extending from motor 8.

Figure 6:
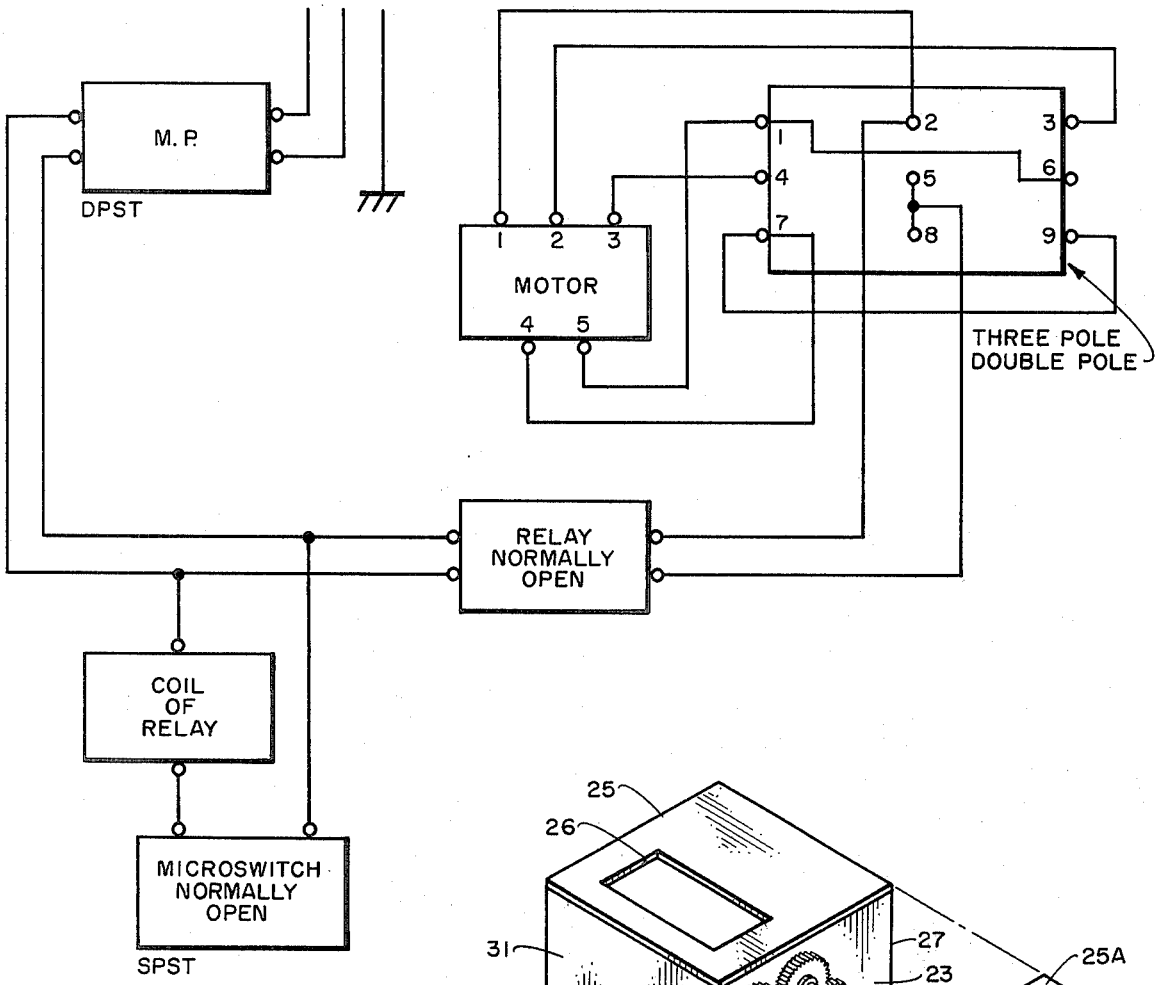
FIG. 6 is a wiring diagram of the device of this invention.

Reversing switch 59 is secured to switch plate 61, which in turn is extended upon wall 23. Master power switch 73 is suitably mounted through wall 29, and is electrically connected to electrical leads 30, as well as to reversing switch 59. Details of the electrical connections are being made in the wiring diagram as shown in FIG. 6 and discussed in the text thereto. Motor mount bracket 71 is suitably secured by bolts 77 to rear wall 27. Electrical lead 32 is grounded to one of said bolts 77. Motor 8 is connected on each end of U-shaped motor mount 71 by collars 78. The use of such motor mounts and collars is known to the art.

A can support 2, generally T-shaped, comprising a bracket 49 mounted on wall 31 by bolts 50 and suitably secured to channel 51 is provided. Can support 2 is positioned beneath reciprocal head 6 for supporting a can thereon in between the fixed walls. Parallel aligned slots 6B are adapted to allow head 6 to travel along screws 3, 3A without impinging on the upstanding sections of channel 51. A can to be mashed is supported on the upstanding sections of channel 51. Openings 48 are of a width sufficient to have a crushed can 36 pass therethrough after the crushing cycle. Adapter 53 has an arc shaped lower edge adapted to prevent crushed cans 36 from moving upwardly. Adapter 53 is secured to the fixed walls by bolts 54.

Reinforcement rod 47 is seen to connect wall 29 and wall 23 to prevent deformation of the housing as a result of the constant force against each of said walls due to the crushing efforts of mashing head 6. If desired additional reinforcing bars can be provided at suitable locations between the walls.

It is seen that no bottom wall is provided. Thus, crushed cans 36 can fall directly into a collection receptacle.

Figure 4:
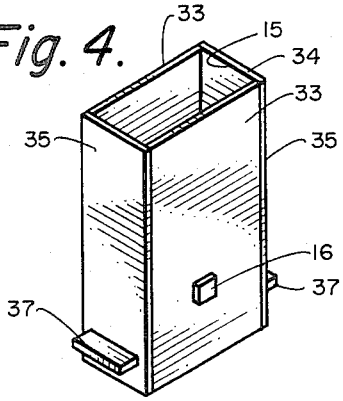
FIG. 4 is a perspective view of a portion of this invention.
Figure 5:
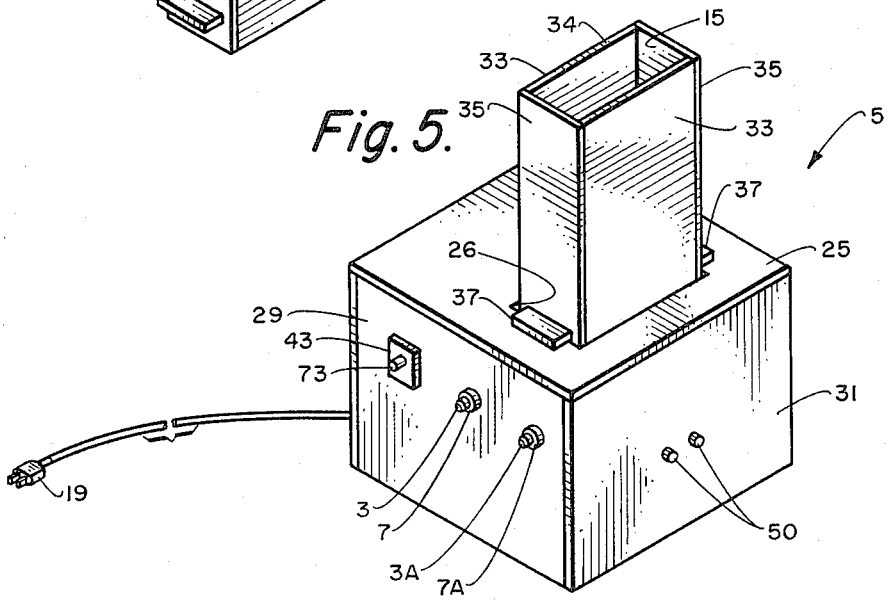
FIG. 5 is a front perspective of a second embodiment of this invention.

By reference to either FIG. 1 or FIG. 5 there will be seen can loading chute 11 mounted upon top wall 25. In detail FIG. 4 depicts loading chute 11 seen to comprise a generally rectangular structure having four upstanding walls, namely front and rear walls 33 and end walls 35. A top surface 34 is formed from the thickness of the four walls which are positioned to form a generally rectangular chute. Opening 15 therein extends downwardly the length of said chute 11 and is sized to accommodate aluminum beverage cans of twelve ounce capacity. While cans of smaller dimensions may be employed, it may be beneficial to utilize an adapter which extends vertically downward and which is sized to accommodate smaller cans such as the seven ounce size as provided by several of the major brewing companies.

As beverage cans are all of the same diameter, the volume differential being made up by the height of the can, it is seen that by extending the length of walls 33 and the size of opening 15, as well as the corresponding opening 26 on top of wall 25, that larger cans, such as the sixteen ounce beer cans, can be crushed by the device of this invention.

Chute 11 is sized for its width and length dimensions to be slightly smaller than the width and length of opening 26 such that chute 11 can be inserted therein. Chute 11 is retained relative to top 25 by at least a pair of stops 37 mounted on walls 35 to a pre-determined position along the elevation of side wall 35.

As can be inferred from above the opening 15 is sized to accommodate a plurality of cans not seen, all of which are stacked one upon the other vertical within the confines of chute 11. It follows therefore that as one can is delivered to support 2 for crushing, the remaining cans within the chute move downwardly a distance of one can during the operation of one stroke of the machine.

In the embodiment illustrated, the chute 11 is arranged so that the can to be fed in between the reciprocating mashing head 6 and one of the fixed walls slidingly engages the mashing head 6 so that as the head 6 moves towards wall 29, the can positioned to slidably engage the mashing head 6 falls vertically down chute 11 onto the mashing head 6 and said moves toward wall 29 and the can falls tilting vertically down onto channel 51 once the head moves past the vertical plane extending down from the leftward end of opening 26. As the previous can's crushing is completed, the next can fully seats itself on channel 51 in expectation of the return stroke of head 6. At all times the lowermost can in the chute is supported by the can resting on channel 51 and the head 6. Head 6 is positioned such that its top surface is slightly lower than the uppermost point on the can's circumference while said can is at rest on channel 51.

The safety feature of the device of this invention lies in the use of a microswitch, per FIG. 4. If chute 11 is not in place, the device is not operable without special efforts being made to overide the microswitch. Thus, while master power switch 43 must be activated to turn on the machine, cans can only be fed to the mash head 6 when microswitch 16 is engaged electrically. This switch can only be activated by the physical abuttment of a can against the switch's actuation lever.

The switch is mounted on wall 33 at a point above the bottommost can in the chute. Thus, if one were to physically reach down into the chute to activate the machine, it would be extremely difficult to mash one's fingers as there would be two cans stacked vertically to impede contact with the mash head 6. One can would be resting on channel 51 and the second would be at the bottom of the chute.

As a result of this construction, it is seen that at all times there will remain two uncrushed cans in the device, one at rest and one in the chute when the device is de-energized due to the lack of a third can to press upon the microswitch.

In order to assume a straight vertical feed of cans from the chute, only a minimal amount of clearance is permitted between the top of a can and the side wall 35 and the bottom of a can and its side wall 35, usually less than the thickness of an adult's fingers.

It is seen that spaces 48 are provided between each of the side fixed walls 29 and 23 and their respective ends of channel 51. These spaces 48 are sized to be greater than the length of the crushed side walls of a crushed can such as 36. When the mash head 6 reverses, the crushed can is free to drop downwardly as no pressure is being applied to retain it against its abutting fixed wall.

Figure 10:
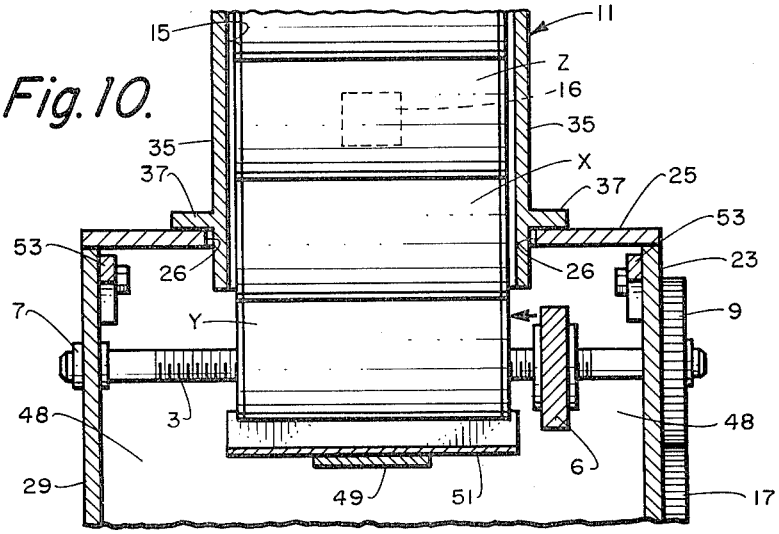
FIGS. 10, 11 and 12 are fragmented perspective views illustrating three points of line of one stroke of a crushing cycle as carried out by the device of this invention.
Figure 11:
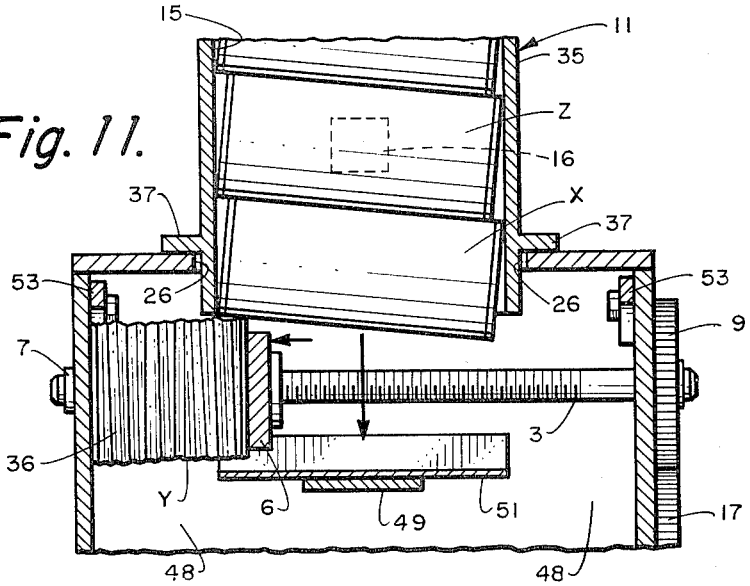
Figure 12:
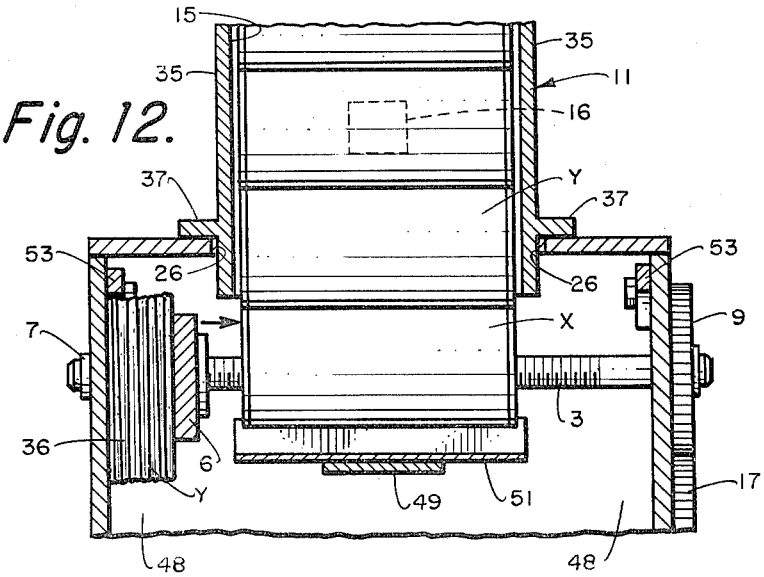

Thus per FIG. 10, FIG. 11 and FIG. 12 wherein for ease of understanding walls 31 and 33 are removed, and it is seen that head 6 is moving towards wall 29 to crush a can Y and upon completion of this aspect of the crushing step, can X which is resting on Y (FIG. 10) begins to become positioned in between reciprocal head 6 and fixed wall 29 for the next crushing operation which will occur when reciprocal head 6 is reversed after producing a crushed can Y. In FIG. 11 head 6 has travelled leftwardly and can X is beginning its descent onto channel 51. When the head has passed the edge of 26, as in FIG. 12, the can X completes its descent and comes to rest on channel 51 to await the completion of the crushing cycle of Y and the reversal of direction of head 6. Such continuous crushing will continue as long as there is a third can Z, impinging upon microswitch 16 as previously explained.

Figure 9:
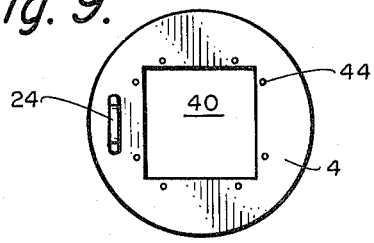
FIG. 9 is a top plan view of the optional base for the device of this invention.

As a can is crushed it falls vertically downward for collection after the release of pressure upon it by the reversal of direction of head 6. An easy mode of collection is seen in FIG. 1, with the details shown in FIG. 9. There is disclosed a suitable support or base 4 to which the device of this invention can be readily mounted. Such support 4 comprises a trash can 14 having a modified lid with at least one handle 24, an opening 40 sized slightly smaller than the dimensions of device 5 and having a plurality of bolt holes 44 for the insertion of bolts therethrough (not seen) into the edges of the walls of device 5. Obviously other mount means, such as L-shaped brackets, are securable to support 4 and the walls of device 5 may be employed.

By using such a support means, as each trash can 14 is filled with crushed cans, the device 5 can be readily moved to another can for continued collection of crushed cans.

While the device 5 is intended for crushing aluminum cans, since these are readily recyclable and money is offered for the return of aluminum crushed cans, it is obvious that by the use of a stronger motor and the proper selection of materials for walls 29 and 23 and head 6, that steel cans could be crushed as well.

It has been indicated earlier that there are two embodiments to the invention. The differences between the two are only cosmetic and the distinction is readily seen by reference to FIGS. 7 and 8.

Figure 7:
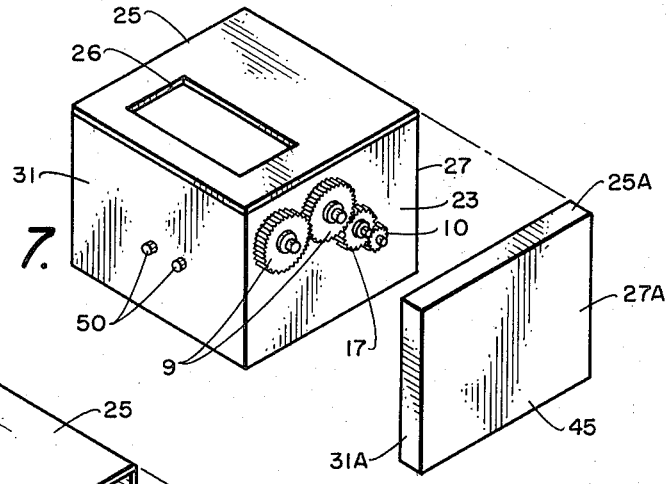
FIGS. 7 and 8 are exploded views depicting in perspective the two embodiments of this invention.

In FIG. 7 wall 31 and wall 27 terminate at intermedia wall 23. The gears are enclosed by a shoe box top shaped cover 45 comprised of walls designated A versions of the corresponding walls of device 5. The cover 45 may abut the edges or overlay the edge of the respective walls of device 5 and be secured thereto by means not shown.

Figure 8:
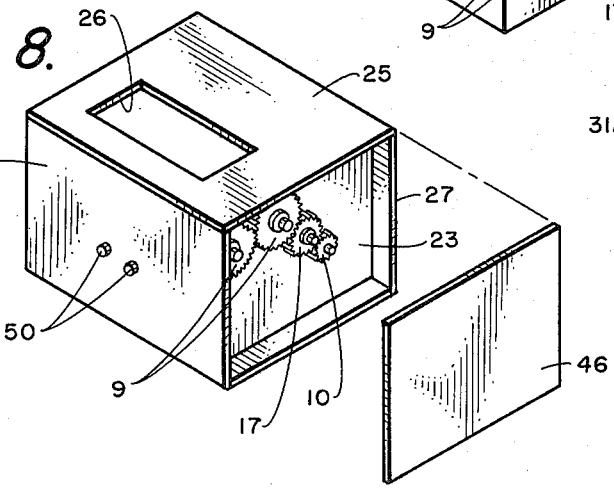

Alternatively, in FIG. 8 walls 31, 25 and 27 can extend beyond the gears thus requiring only a flat cover plate 46. Both embodiments of these two figures are in all other facets mechanically and operationally the same.

The interrelationship of the plurality of switches employed, namely the master power switch 43, the reversing switch 59 and the microswitch 16, is seen in the electrical wiring diagram of FIG. 6. A relay 28 is preferrably employed in conjunction with microswitch 16 in order not to burn out microswitch 16 due to its having excessive amounts of current flow therethrough.

Also necessary for the operation of device 5 is the power line and plug 19, which enter through conduit 75 suitably secured to both sides of aperture 76 in rear wall 27. As is seen, two of the three leads 30 go to master power switch 43 which is operated by handle 73, while the third 32 goes to ground.

In practice we have found that excellent results may be obtained when the motor employed is a single phase-split phase reversing field motor of one-third horsepower operating at 1800 R.P.M. For the relay a G.E. four pole double throw type CR 281 CA achieves the desired results.

It is seen that there has been disclosed herein a device comprising a laterally reciprocating mashing head having two flat parallel faces, which head reciprocates between two fixed walls to apply axial pressure to the top or bottom of a beverage can to crush said can, a first can, between on face of said head and one of the fixed walls while a second can waits to be crushed. This second can drops from a feed chute to slidingly engage the head. The side wall of the second can rests upon the first can until it drops onto the can support when the mash head has moved substantially toward one of the fixed heads, thus completing the crushing of the first can. The head reverses and the second face crushes the second can. Cans continue to be crushed by alternate faces of the head.

It is readily seen that the mashing head 6 of this device instead of being reciprocated by a reversing switch 59 acting in concert with an electric motor 8, the reciprocation can be carried out by means of a hydraulically operated system. That is, as the head moves from right to left, a valve is actuated by impingement of the head 6 thereupon. The other components necessary to operate the device to reciprocate the head hydraulica are all state of the art and as such it is within the skill of the artisan to employ a hydraulic prime mover for motor 8 herein.

Since certain changes may be made in the above apparatus without departing from the scope of the invention herein involved, it is intended that all matter contained in the above description and shown in the accompanying drawings shall be interpreted as illustrative and not in a limiting sense.

We claim:

1. A can crusher comprising:

a pair of opposed fixed walls;

laterally reciprocal mashing head means reciprocable relative to said opposed fixed walls;

means for reciprocating said reciprocal head means between said opposed fixed walls;

fixed support means for supporting a single can lengthwise between said opposed fixed walls, said support means extending laterally between said fixed walls, a distance from a midpoint of said support means to a fixed wall being greater than half the lateral extent of said support means by a predetermined amount, said predetermined amount being greater than the length of a crushed can, and said support means being fixed relative to said fixed walls and disposed beneath said reciprocal mashing head means;

can stacking and feeding means for stacking cans in a vertical row and for feeding cans one at a time to said reciprocal mashing head means, which can stacking and feeding means includes a vertical chute positioned adjacent said reciprocal head means which chute is only sized wide enough to accommodate a one-can width wide column of cans, and which vertical chute gravity feeds one can at a time to said mashing head means where a side wall of said can slidingly engages the mashing head means, said can falling lengthwise onto said fixed support means as said mashing head means moves toward either one of said fixed walls, said mashing head means engaging and crushing said can upon moving toward the opposite wall;

switch means mounted on said stacking and feeding means for activating the means for reciprocating said reciprocal head means, said switch means being adapted for activation by the impingement of a can in said stacking and feeding means;

said fixed walls having flat and parallel confronting faces;

said reciprocal head means including a single head having two opposed flat and parallel faces, each of said faces in said head being parallel to the faces of said fixed walls;

said head engaging confronting rims of a can to apply axial pressure to crush the side walls of a can between one face of said head and one of said fixed walls.

2. The can crusher of claim 1 wherein said reciprocating means comprises threaded shaft means operably connected to said reciprocal head means for moving said reciprocal head means in a reciprocating direction, said threaded shaft being mounted between said fixed walls; prime mover means operably connected to said threaded shaft means for rotating said threaded shaft means in a manner to reciprocate said reciprocal head.

3. The can crusher of claim 2 wherein said prime mover means comprises a reversible motor and switch means operably connected to said motor and mounted at one fixed wall for reversing the direction of said motor, said switch being actuated when said reciprocating head means is moved next adjacent to one of said fixed walls.

4. In the device of claim 1 further including a base for said can crusher adapted to serve as a closure for a trash container and having an opening therein, whereby crushed cans are able to drop directly into said container.

5. The device of claim 4 wherein means to prevent crushed cans from moving upwardly, mounted on each of said fixed walls is included.

6. The device of claim 5 wherein further including additional switch means to control the power to the switch means mounted in said stacking and feeding means.

7. The device of claim 1 wherein said chute is removably secured to the top of said can crusher.

8. The device of claim 1 further including means to prevent crushed cans from moving upwardly, mounted on each of said fixed walls.

9. A can crusher comprising:

a pair of opposed fixed walls;

laterally reciprocal mashing head means reciprocable relative to said opposed fixed walls;

means for reciprocating said reciprocal head means between said opposed fixed walls;

fixed support means for supporting a single can lengthwise between said opposed fixed walls, said support means extending laterally between said fixed walls, a distance from a midpoint of said support means to a fixed wall being greater than half the lateral extent of said support means by a predetermined amount, said predetermined amount being greater than the length of a crushed can, and said support means being fixed relative to said fixed walls and disposed beneath said reciprocal mashing head means;

can stacking and feeding means for stacking cans in a vertical row and for feeding cans one at a time to said reciprocal mashing head means, which can stacking and feeding means includes a vertical chute positioned adjacent said reciprocal head means which chute is only sized wide enough to accommodate a one-can width wide column of cans, and which vertical chute gravity feeds one can at a time to said mashing head means where a side wall of said can slidingly engages the mashing head means, said can falling lengthwise onto said fixed support means as said mashing head means moves toward either one of said fixed walls, said mashing head means engaging and crushing said can upon moving toward the opposite wall;

safety switch means for activating the means for reciprocating said reciprocal head means, which safety switch means includes a first switch mounted on one of said fixed walls and a second switch mounted on said vertical chute above a bottom end of said chute, said second switch being adapted for activation by the impingement of a can in a vertical row of cans in said vertical chute against said second switch, both said first and second switches having to be activated to activate said means for reciprocating said reciprocal head means;

said fixed walls having flat and parallel confronting faces;

said reciprocal head means including a single head having two opposed flat and parallel faces, each of said faces in said head being parallel to the faces of said fixed walls;

said head engaging confronting rims of a can to apply axial pressure to crush the side walls of a can between one face of said head and one of said fixed walls.

10. A can crusher comprising:

a pair of opposed fixed walls;

laterally reciprocal mashing head means reciprocable relative to said opposed fixed walls;

means for reciprocating said reciprocal head means between said opposed fixed walls;

fixed support means for supporting a single can lengthwise between said opposed fixed walls, said support means extending laterally between said fixed walls, a distance from a midpoint of said support means to a fixed wall being greater than half the lateral extent of said support means by a predetermined amount, said predetermined amount being greater than the length of a crushed can, and said support means being fixed relative to said fixed walls and disposed beneath said reciprocal mashing head means;

can stacking and feeding means for stacking cans in a vertical row and for feeding cans one at a time to said reciprocal mashing head means, which can stacking and feeding means includes a vertical chute positioned adjacent said reciprocal head means;

safety switch means for activating the means for reciprocating said reciprocal head means, which safety switch means includes a first switch mounted on one of said fixed walls and a second switch mounted on said vertical chute above a bottom end of said chute, said second switch being adapted for activation by the impingement of a can in a vertical row of cans in said vertical chute against said second switch, both said first and second switches having to be activated to activate said means for reciprocating said reciprocal head means;

said fixed walls having flat and parallel confronting faces;

said reciprocal head means including a single head having two opposed flat and parallel faces, each of said faces in said head being parallel to the faces of said fixed walls;

said head engaging confronting rims of a can to apply axial pressure to crush the side walls of a can between one face of said head and one of said fixed walls.

* * * * *